US005551273A

United States Patent [19]

Mantovan

[11] Patent Number: 5,551,273

[45] Date of Patent: Sep. 3, 1996

[54] ROLLING STAND WITH TIE-RODS WITH EXTREMELY HIGH STRENGTH TO AXIAL STRESSES

[75] Inventor: Gianfranco Mantovan, Busto Arsizio, Italy

[73] Assignee: Pomini S.p.A., Varese, Italy

[21] Appl. No.: 317,655

[22] Filed: Sep. 30, 1994

[51] Int. Cl.[6] ..... B21B 31/02; B21B 31/08

[52] U.S. Cl. ..... 72/237; 72/238; 72/225

[58] Field of Search ..... 72/225, 237, 238, 72/239, 245, 248

[56] References Cited

U.S. PATENT DOCUMENTS

| | | | |
|---|---|---|---|
| 3,882,710 | 5/1975 | Kersting | 72/237 |
| 3,899,910 | 8/1975 | Aramaki | 72/239 |
| 3,908,426 | 9/1975 | Aramaki | 72/238 |
| 4,121,446 | 10/1978 | Passoni et al. | 72/238 |
| 4,557,130 | 12/1985 | Bond | 72/237 |
| 4,715,206 | 12/1987 | Forni | 72/237 |

FOREIGN PATENT DOCUMENTS

| | | |
|---|---|---|
| 0166478 | 1/1986 | European Pat. Off. . |
| 1939485 | 2/1970 | Germany . |
| 2506449 | 8/1975 | Germany . |
| 1183573 | 3/1970 | United Kingdom . |

*Primary Examiner*—W. Donald Bray
*Attorney, Agent, or Firm*—Oblon, Spivak, McClelland, Maier & Neustadt. P.C.

[57] ABSTRACT

A rolling stand with tie-rods, having extremely high strength to axial stresses, which includes a stand base supporting at least two rolling rolls supported by carriers which can be vertically moved in order to be approached or moved away from each other by means of four vertical tie-rods having screw-threaded portions. The screw-threaded portions are provided on opposite sides of at least one pair of support feet arranged between the stand base and the carriers which support and contain a central smooth portion of the tie-rods. A contoured portion extends from at least one of the support feet upwards and downwards in a parallel direction to the tie-rods. The contoured portion houses and guides a vertical rib protruding outwards from the carriers. Both contoured portion and the vertical rib engage, on mutually opposite surfaces, freely removable adjustment/sliding elements.

10 Claims, 6 Drawing Sheets

ROLLING STAND WITH TIE-RODS WITH EXTREMELY HIGH STRENGTH TO AXIAL STRESSES

BACKGROUND OF THE INVENTION

1. Field of the Invention

The present invention relates to a rolling stand of the type with tie-rods, having extremely high strength to axial stresses, which makes it possible high-precision nonsymmetrical-profile rolled sections to be obtained.

2. Discussion of the Background

The presently used rolling stands of the type with tie-rods (referred to in the following as "tie-rod rolling stands") are such as to enable also rolled sections with particular contours, such as a double-"T" contours, to be manufactured with very good quality.

However, it should be remarked here that these rolling stands operate very well for rolled sections with symmetrical contour. An example of a tie-rod rolling stand of :he above type is disclosed in detail in European patent No. 0 166 478.

If the contour of the cross-section of the rolled section is nonsymmetrical, for example an "L"-shaped contour, stresses arise which, by being oriented parallel to the axis of the rolling rolls, cannot be easily counteracted.

The axial stresses have a detrimental impact on the whole structure of the rolling stand, causing mutually engaged moving components to undergo wear during the rolling process. Among such mutually moving components, we remind here, for example, the lead nuts or threaded rings installed in the carriers, and those components which perform the task of guiding the movement.

This drawback generates clearances in the rolling stand and can also endanger the dimensional tolerances of the rolled section product which consequently may not meet the requirements.

SUMMARY OF THE INVENTION

The purpose of the present invention is of obviating these drawbacks, by providing a tie-rod rolling stand capable of meeting the necessary requirements of strength and stability, i.e., of allowing rolled sections of non-symmetrical profile with any sizes and with very precise dimensional tolerances to be obtained, while simultaneously preventing the components which constitute the rolling stand from undergoing wear.

This purpose is achieved by a rolling stand of the type with tie-rods which displays the features expounded in the appended claims.

The structural and functional characteristics of the invention, and its advantages over the prior art, will be still more evident from an examination of the following disclosure made by referring to the accompanying schematic drawings, which display an example of a tie-rod rolling stand embodying the principles of the same invention.

DESCRIPTION OF THE PREFERRED EMBODIMENTS

Figure 1:
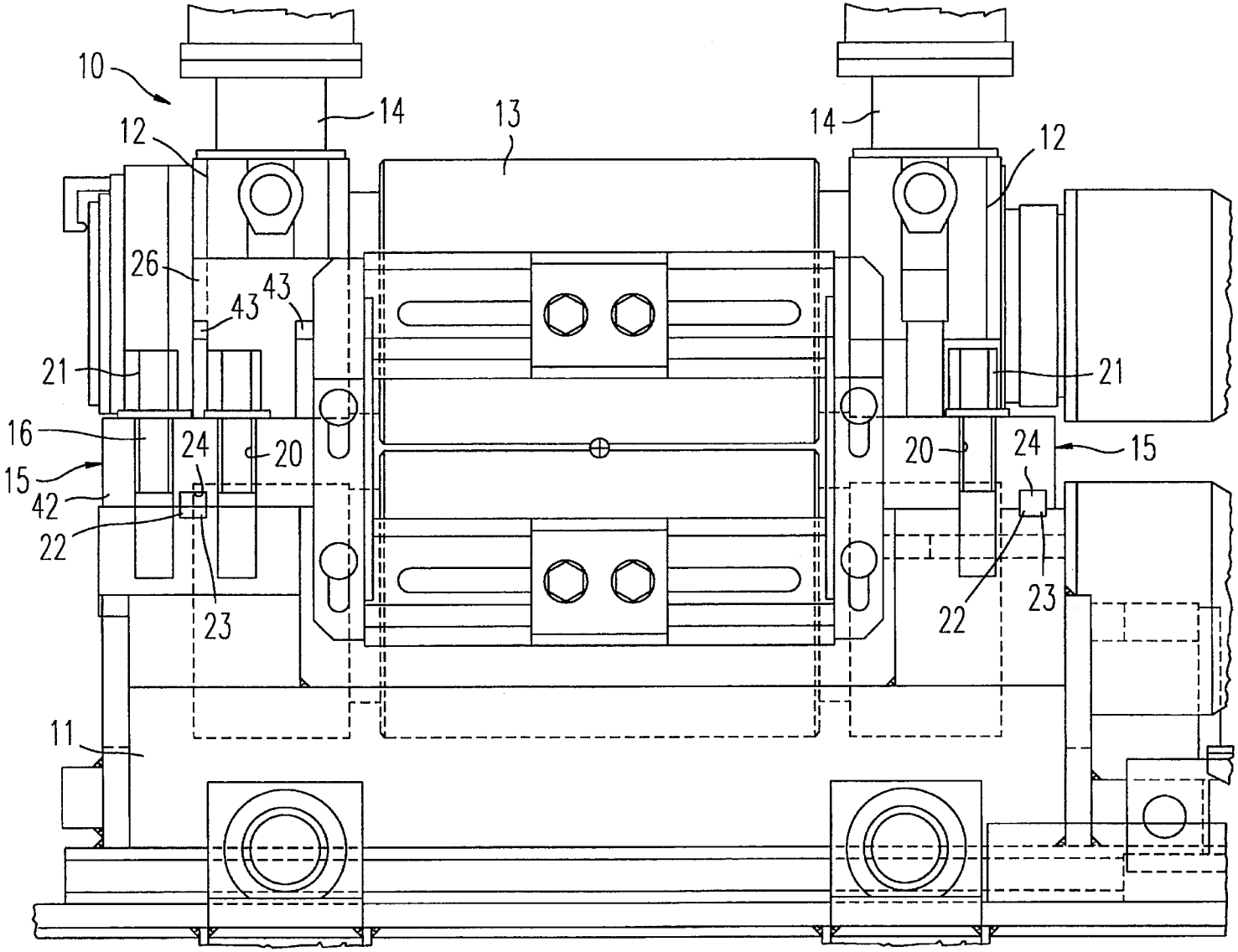
FIG. 1 shows a front elevation view illustrating a rolling stand of the type with tie-rods according to the present invention.
Figure 2:
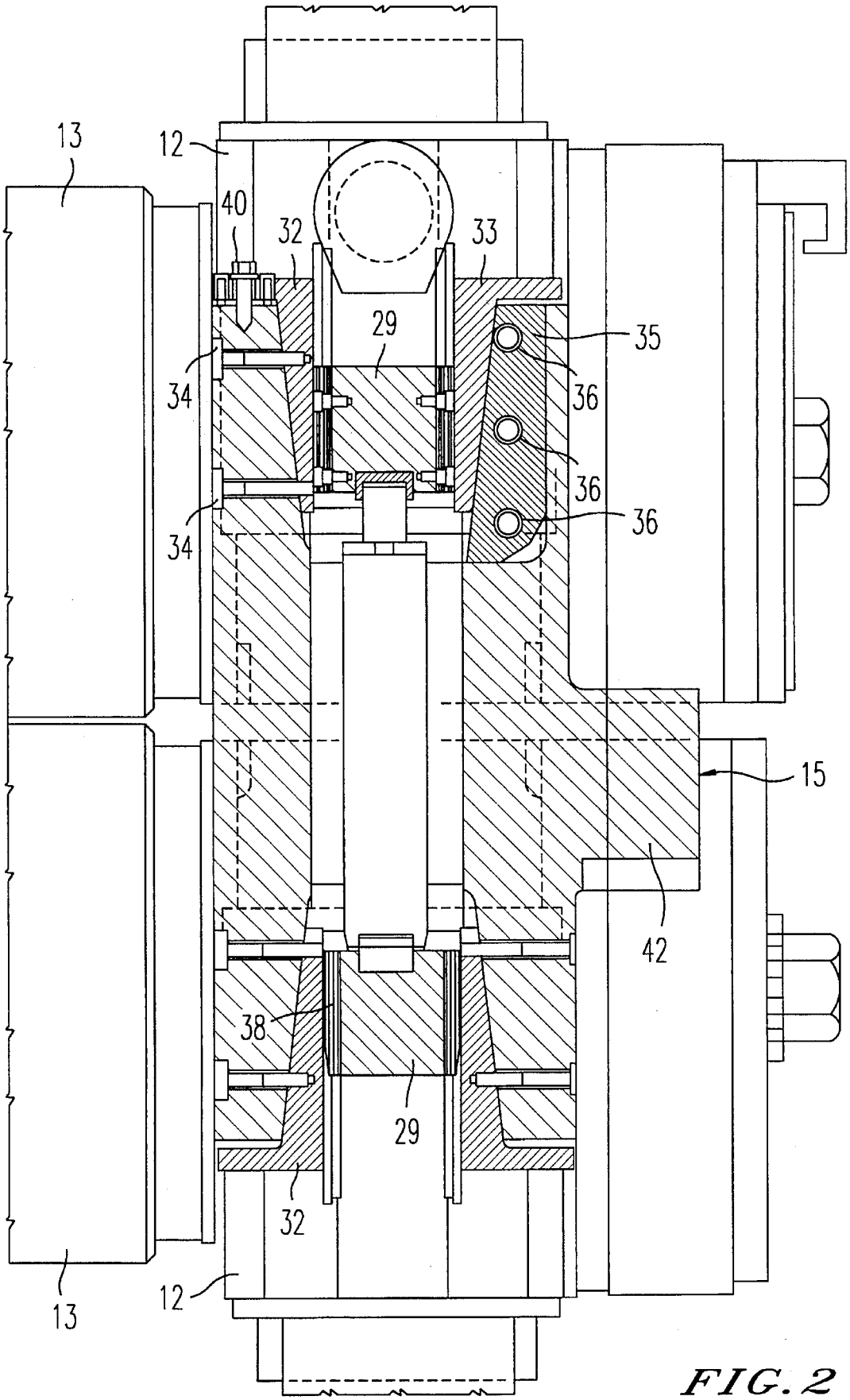
FIG. 2 shows a vertical sectional view, on an enlarged scale, of a side portion of the rolling stand, illustrating a stabilizer/contrast foot provided sideways of the carriers which support the neck of the rolling rolls.
Figure 3:
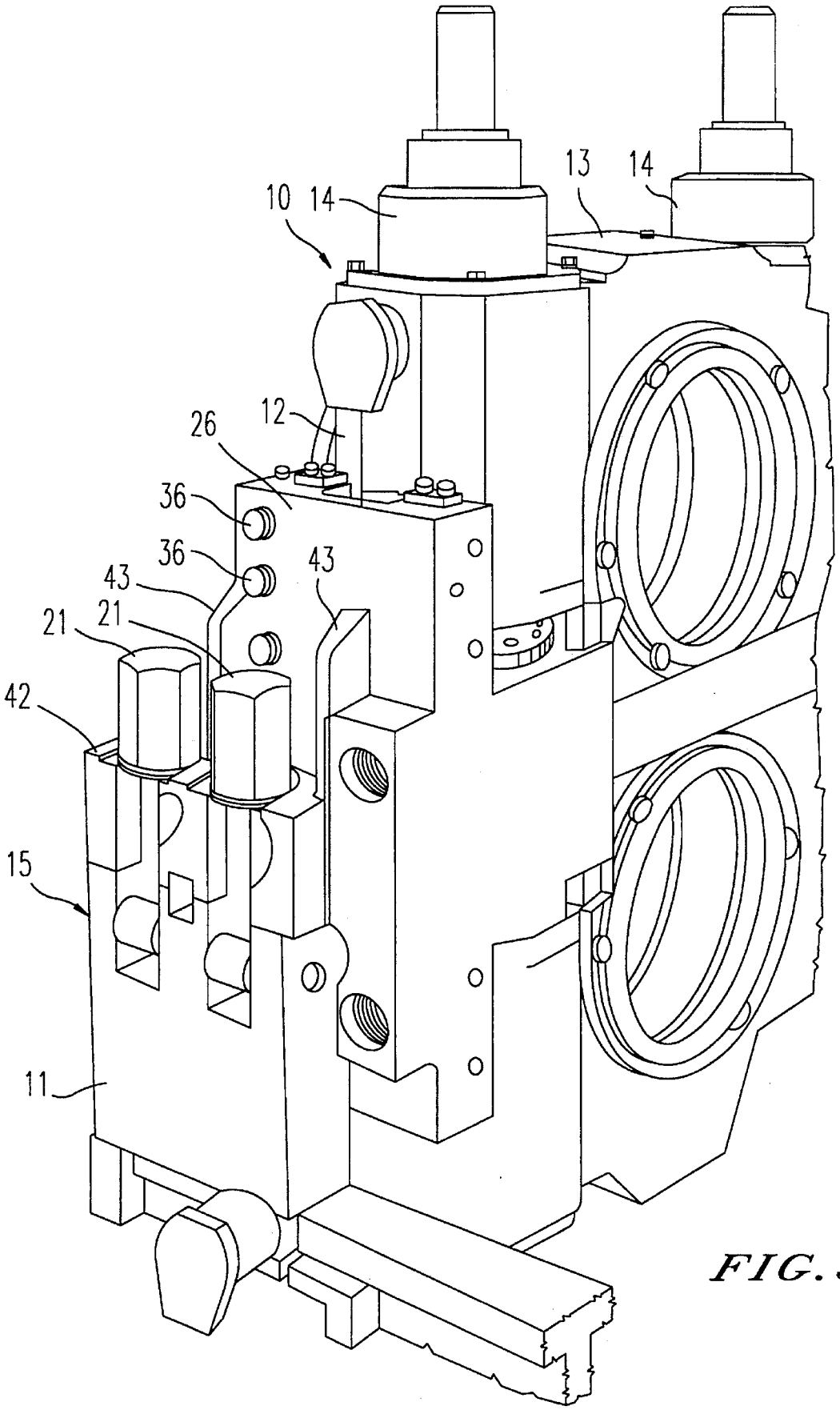
FIG. 3 shows a top perspective view illustrating a portion of a shoulder of the rolling stand as displayed in FIG. 2, according to the present invention.

Referring to the figures, the tie-rod rolling stand according to the invention is generally indicated with 10 and is structurally formed by a stand base 11 performing the task of containing carriers 12 supporting at least one pair of respective horizontal rolling rolls 13.

The rolling rod according to the present invention is provided with tie-rods or setscrews 14 which enable the rolling rolls 13 to be adjusted in position relatively to each other, driven by an adjustment/synchronism unit arranged above the rolling stand and not illustrated, because it is of a well-known type for those skilled in the art. This unit causes the carriers 12 bearing the rolling rolls 13, to be vertically moved towards or apart from each other.

On the stand base 11, according to the present invention, four support feet or bases, generally indicated with 15, are mounted and constrained to it by means of eye tie-rods 16 which are hinged, at their bottom ends 17, onto the stand base 11.

The eye tie-rods 16 are hinged, through a shaft 18, inside hollows 19 provided in the stand base 11, can rotate around the shaft 18 and can be inserted inside purposely provided hollows 20 of the support feet 15, inside which they are fastened by means of nuts 21.

The support feet 15 are also centered relatively to the stand base 11, by means of keys 22 positioned inside complementary, mutually opposite key seats 23 and 24 provided in the support feet 15 and in the stand base 11, and protruding ribs suitable for being housed inside corresponding seats, not shown in the drawings.

Each support foot 15 protrudes inside the interior of the rolling stand, to form a sleeve portion 25 which receives a central, smooth portion 25' of the tie-rods 14.

Outside the rolling stand, each support foot 15, according to the present invention, extends into two "C"-shaped portions 26, extending upwards and downwards to surround, at least partially, the external sides of the carriers 12.

The tie-rods 14 have screw-threaded portions 27, provided on opposite sides of the support foot 15, which receive ring nuts 28 integral with the stand base relatively to the rotation inside the carriers 12.

The carriers 12 are provided, along side portions thereof, in perpendicular direction to the direction of the axes of the rolling rolls 13, with outwards protruding, vertical ribs 29 which get engaged inside the contoured portions 26 of the support feet 15.

As shown by FIGS. 2–5, the "C"-shaped portions 26 have, in section, an enlarged end portion 30 and an opposite, thinned end portion 31. Inside such end portions 30, 31 adjustment wedge elements 32, 33 are housed, which are horizontally fastened the one, in parallel direction to the axes of the rolling rolls; and the other, in perpendicular direction to the axes of the rolling rolls. The wedge elements 32 and 33 are freely removable adjustment/sliding elements.

Figure 4:
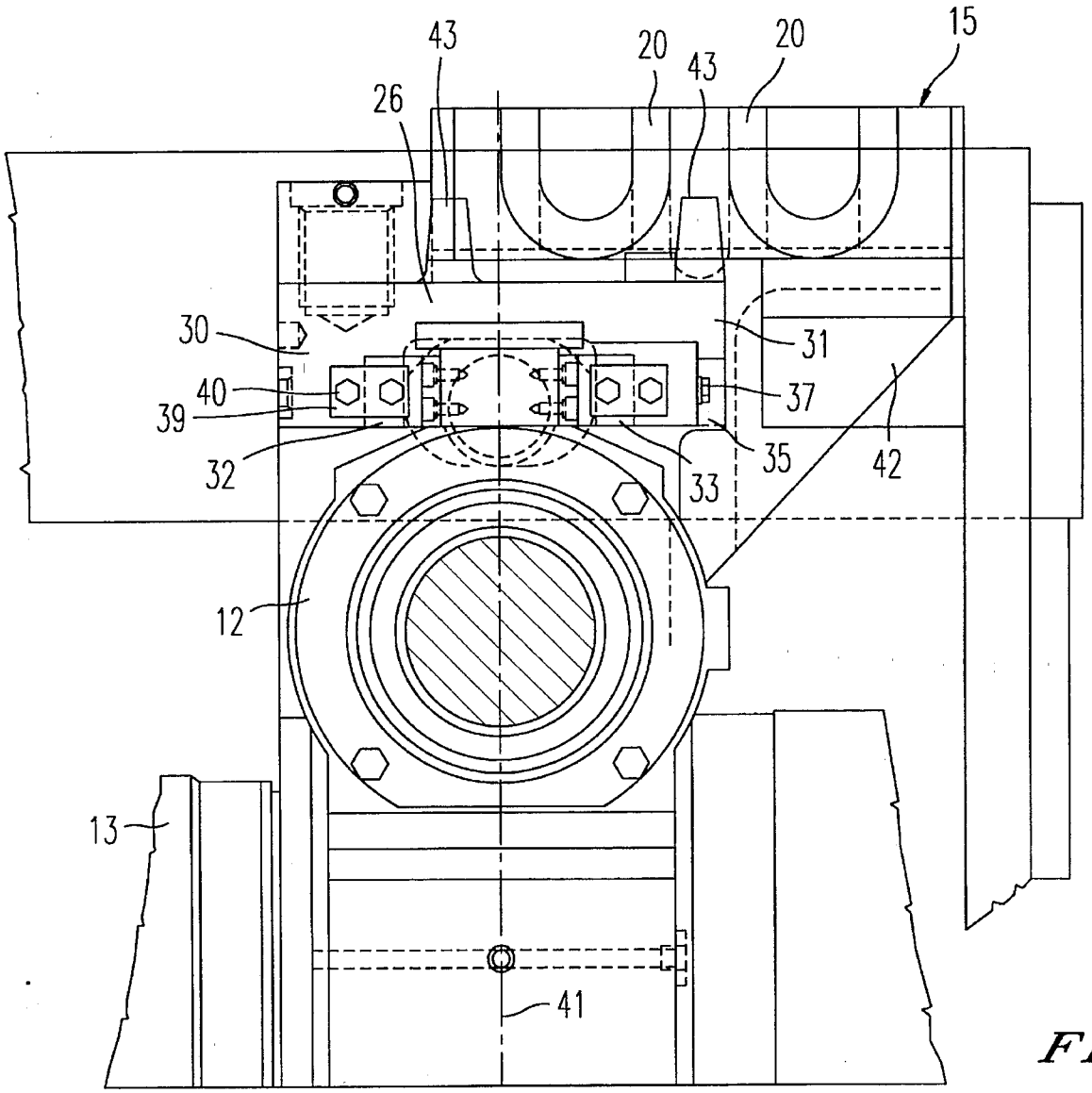
FIG. 4 shows a top plan view illustrating a half of a shoulder of the rolling stand as displayed in FIG. 2, without the eye tie-rods which are used to fasten it to the stand base.

As it can clearly be seen from FIG. 4, the enlarged end portion 30 is facing the interior of the rolling stand in which the rolling rolls are housed, and, in this example, the relevant wedge element 32 is fastened by means of at least two fastening screws 34.

The opposite, thinner end portion 31 facing the outside of the rolling stand houses an "L"-shaped support block 35 fastened by means of three side screws 36. In its turn, the wedge element 33 is fastened by means of screws 37 to the support block 35 and is constrained to the whole structure of the support foot 15.

The wedge elements 32 and 33 have an "L"-shape and their inner, longer side acts as an slant plane, and cooperates, in order that the wedge elements can be correctly positioned, with complementary slant planes internally provided on the enlarged end portion 30 and on the support block 35.

However, on both wedge elements 32 and 33 crowned runners 38 slide, which act as freely removable sliding elements, constrained, on opposite sides, to the bottom end of the vertical rib 29 protruding from the carriers 12.

The crowned runners 38 enable the carriers 12 to match the deformations of the rolling rolls 13.

FIG. 4 displays how each "L"-shaped wedge element 32 and 33 is further fastened by means of a small plate 39 provided above the base of the "L"-shape of the wedge element.

The small plate 39 constrains, through screws 40, the wedge element 32 to the enlarged end portion 30 of the "C"-contoured portion 26. In an analogous way, the small plate 39 constrains, through screws 40, the wedge element 33 to the support block 35.

Figure 5:
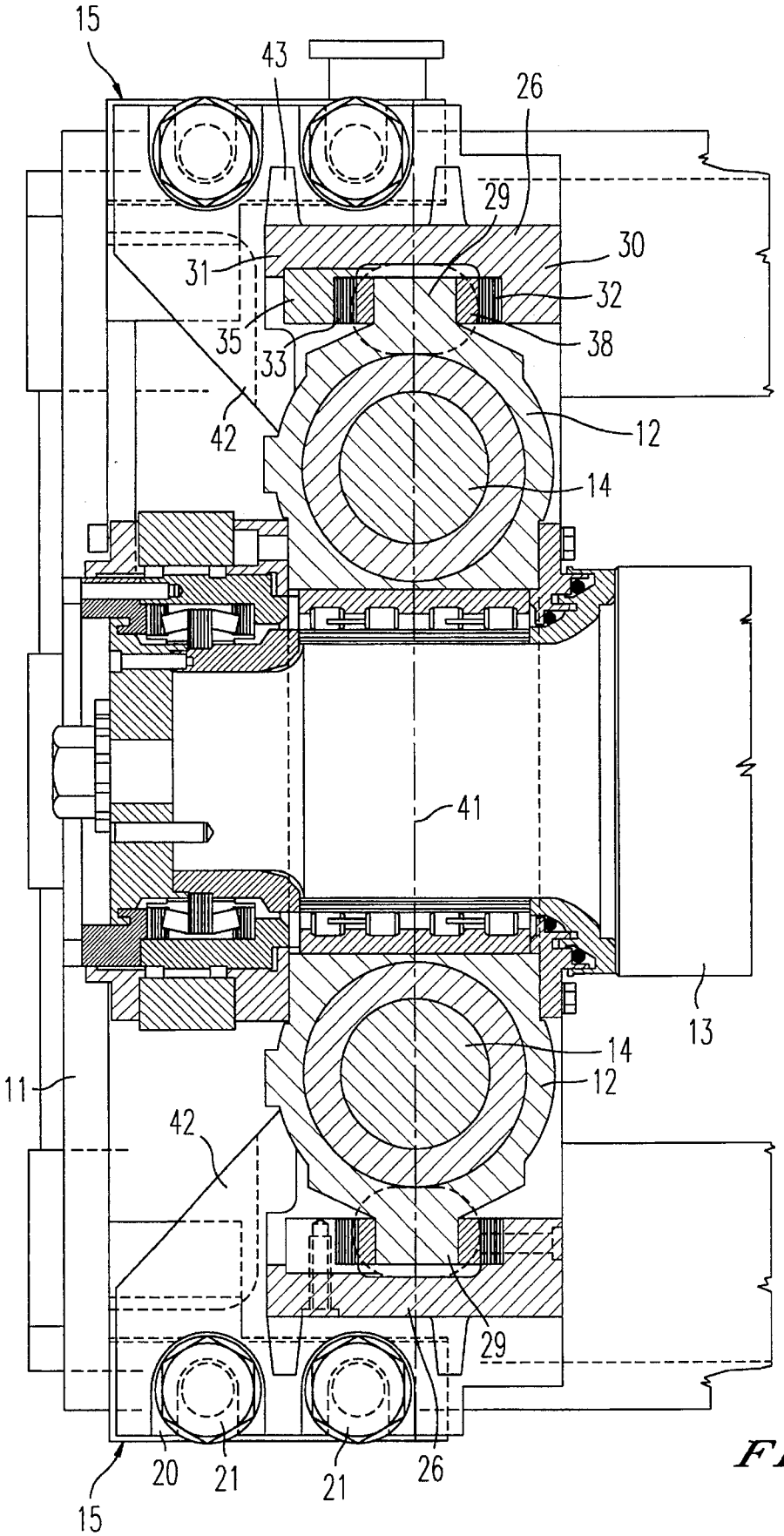
FIG. 5 shows a horizontal sectional view seen from upwards, of the shoulder with the stabilizer/contrast foot at the bearings which support the neck of a rolling roll between the tie-rods or setscrews.
Figure 6:
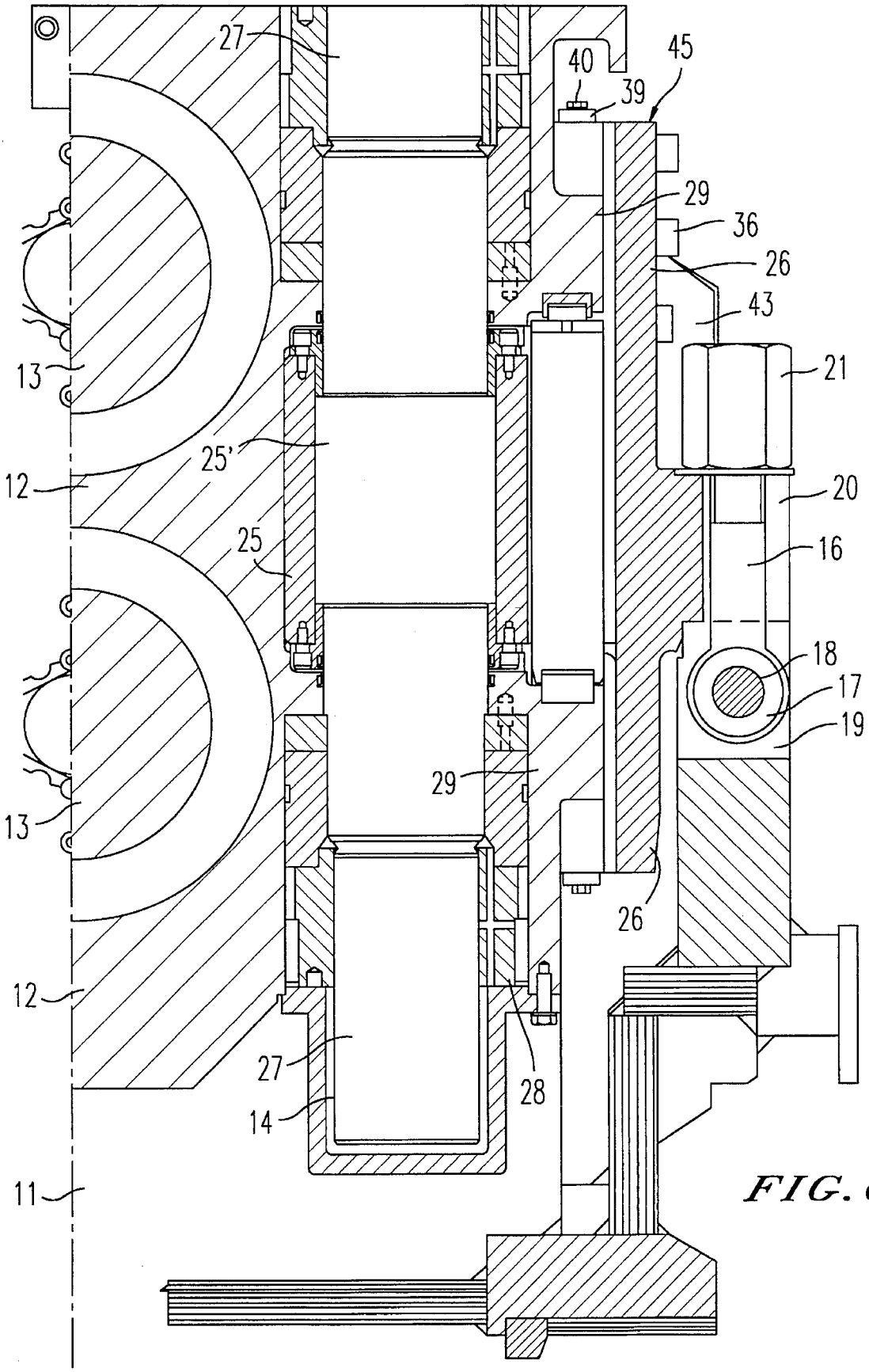
FIG. 6 shows a vertical sectional view of a half of the shoulder with foot of FIG. 2.

FIGS. 4 and 5 show top plan views of the support foot 15 of the tie-rod rolling stand according to the invention, which has a nonsymmetrical body aligned with the axis 41 running through the centers of the tie-rods 14. From its sleeve portion 25, the body of the support foot 15 extends towards the outside of the rolling stand into a slant portion 42 which acts like a strut in order to counteract the axial thrusts generated by the rolling rolls 13.

In the slant, strut-acting portion 42 the hollows 20 are provided which receive the eye tie-rods 26—with, in the instant example, two of them being provided.

The general structure of the support feet 15 is such as to bear the operating axial load which is generated during the rolling of a nonsymmetrical rolled section.

In this situation of the structure, the rolling stand according to the present invention displays a very high stiffness and secures that rolled sections will be produced in the desired size, with very narrow dimensional tolerances. Of course, the shape of the upwards/downwards extending "C"-shaped portions 26, as well as of the wedge elements 32 and 33 results to be designed for an easy servicing.

In the event that the mutually engaging parts undergo wear owing to the stresses they are submitted to, and to their mutual sliding, the screws 34 and 37 make it possible the wedge elements 32 and 33 and the screws 36 to be easily and rapidly removed, with the support block 35 being as easily and rapidly removed too.

The wedge elements 32 and 33 can thus be replaced and in the event that their coupling planes with the contoured portions 26 are no longer perfectly smooth, they can be levelled off, with a correct coupling being restored.

Also the support block 35 of the wedge element 33, subject to a higher axial stress, can be reprocessed in order to restore the coupling planarity of the parts.

The rolling stand of the present invention can be provided with such support feet at one shoulder only, or, according to and alternative embodiment, the support feet can be provided at both rolling stand shoulders.

Externally to the support feet on the "C"-shaped portions, vertical ribs 43 can be provided which act to further stiffen the structure thereof, i.e., stabilize the whole tie-rod rolling stand.

Also a tie-rod rolling stand according to the present invention is suitable for being horizontally opened, i.e., by moving apart the shoulders containing the carriers and the supports, in order to remove the rolling rolls, which remain in their position, and replace them with a new pair of rolling rolls. This result can be attained because both the old (i.e., presently installed) rolling rolls, and the new rolling rolls (i.e., the rolling rolls which the operator wishes to install) are borne by a suitable service unit according to U.S. Pat. No. 4,552,007.

I claim:

1. Rolling stand comprising:

a stand base;

at least two rolling rolls and carriers supporting said at least two rolling rolls, said rolling rolls supported by said carriers being supported by said stand base;

plural vertical tie-rods operable to move said carriers vertically towards or apart from each other, said tie-rods having screw-threaded portions;

at least one pair of support feet arranged between said stand base and said carriers, said support feet supporting a central portion of said tie-rods, said tie-rods having screw-threaded portions provided on opposite sides of said support feet;

at least one of said support feet having a contoured portion extending vertically parallel to said tie-rods;

at least one of said carriers having a vertical rib housed and guided in said contoured portion; and removable adjustment and sliding elements provided in said contoured portion interposed between said contoured portion and said rib with said removable adjustment and sliding elements having opposite surfaces contacting said contoured portion and said rib, respectively.

2. Rolling stand according to claim 1, wherein said contoured portions and said vertical ribs are arranged at opposite side ends of said carriers aligned to an axis running through centers of one pair of said tie-rods.

3. Rolling stand according to claim 1, wherein said contoured portion has a "C"-shaped cross-section.

4. Rolling stand according to claim 3, further comprising:

crowned sliding elements provided between said rib and said removable adjustment and sliding elements, wherein said contoured portion with the "C"-shaped cross-section has an enlarged end portion and a thinned end portion, said contoured portion engages said removable adjustment and sliding elements.

5. Rolling stand according to claim 1, wherein said removable adjustment and sliding elements provided in said contoured portion are wedge elements.

6. Rolling stand according to claim 5, wherein at least one of said wedge elements is fastened onto a small support block which is fastened to said contoured portion in a thinned portion thereof.

7. Rolling stand according to claim 6, wherein said wedge elements have an "L"-shape including a base portion, the base portion of one of said wedge elements is fastened to said contoured portion, and the base portion of the other of said wedge elements is fastened to said support block.

8. Rolling stand according to claim 1, comprising:

eye tie-rods connecting said support feet with said stand base; and keys housed inside mutually complementary seats which are provided partially on said support feet and partially on said stand base to center said stand base and said support feet.

9. Rolling stand according to claim 1, wherein said support foot, in a central portion thereof, extends towards the outside into a slant, strut-acting portion.

10. Rolling stand according to claim 1, wherein said contoured portion of said support feet comprises an externally provided vertical stiffening rib.

* * * * *